US007508346B2

(12) United States Patent
Rao et al.

(10) Patent No.: US 7,508,346 B2
(45) Date of Patent: Mar. 24, 2009

(54) DUAL-POLARIZED, MICROSTRIP PATCH ANTENNA ARRAY, AND ASSOCIATED METHODOLOGY, FOR RADIO DEVICE

(75) Inventors: Qinjiang Rao, Waterloo (CA); Geyi Wen, Waterloo (CA); Mark Pecen, Waterloo (CA)

(73) Assignee: Research In Motion Limited, Waterloo, Ontario ( * ) Notice: Subject to any disclaimer, the term of this patent is extended or adjusted under 35 U.S.C. 154(b) by 0 days.

(21) Appl. No.: 11/735,580

(22) Filed: Apr. 16, 2007

(65) Prior Publication Data

US 2008/0252529 A1 Oct. 16, 2008

(51) Int. Cl.
*H01Q 1/38* (2006.01)

(52) U.S. Cl. ..... 343/700 MS

(58) Field of Classification Search ..... 343/700 MS, 343/846, 848, 853, 702
See application file for complete search history.

(56) References Cited

U.S. PATENT DOCUMENTS 6,124,830 A * 9/2000 Yuanzhu ..... 343/700 MS
6,700,542 B2 * 3/2004 Borlez et al. ..... 343/700 MS
6,753,817 B2 * 6/2004 Aikawa et al. ..... 343/700 MS
7,362,272 B2 * 4/2008 Chang et al. ..... 343/700 MS

OTHER PUBLICATIONS

A. Adrian; D.H. Schubert, "Dual-Aperture-Coupled Microstrip Antenna for Dual or Circular Polarization," Electronics Letters, vol. 23., Nov. 1987, pp. 1226-1228.

G.S. Parker, A Dual-Polarized Microstip Ring Antenna with Very Good Isolation, M.E. Thesis, Department of Electrical Engineering, Royal Military College of Canada, Kingston, Canada,1997.

S. Gao; L. W. Li; T. S. Yeo; M. S. Leong, A Broad-Band Dual-Polarized Microstrip Patch Antenna with Aperture Coupling, IEEE Trans. Antennas and Propagation, vol. 51, No. 4, Apr. 2003, pp. 898-900.

R. Bairavasubramanian; D. Thompson; G. Dejean; G. E. Ponchack; M.M Tentzeris; J. Papapolymerous, "Development of mm-Wave Dual-Frequency Multilayer Antenna Arrays on Liquid Crystal Polymer (LCP) Substrate," Antennas and Propagation Society International Symposium, 2005 IEEE, vol. 1B, Jul. 3-8, 2005, pp. 393-396.

* cited by examiner

*Primary Examiner*—Tan Ho

(57) ABSTRACT

A dual-polarized antenna, and an associated methodology, is provided for a radio device, such as a mobile station. The antenna is formed of a plurality of patches configured into an array, symmetrical in both a first polarization direction and a second polarization direction. Adjacent patches of the array are interconnected by connecting strips that are also symmetrically positioned in the two directions. These connecting strips not only act as feeding lines for the patches but also operate as in-phase radiation elements in each polarization direction. A transverse strip extends between a pair of transversely positioned patches. And a single feed connection is provided thereat.

18 Claims, 8 Drawing Sheets

DUAL-POLARIZED, MICROSTRIP PATCH ANTENNA ARRAY, AND ASSOCIATED METHODOLOGY, FOR RADIO DEVICE

The present invention relates generally to an antenna for a portable radio device, such as a Bluetooth-capable or IEEE 802.11b/g-capable device that operates at the IMS (Industry, Medical and Scientific) frequency band. More particularly, the present invention relates to a dual-polarized antenna, and an associated methodology, of compact construction, capable of positioning at, or within, a radio housing of the portable radio device.

An array of corner-positioned patches is disposed upon the substrate. The corner-positioned patches together with connector strips that interconnect adjacent patches are symmetrical in both a first and a second polarization direction and are of dimensions permitting symmetrical excitation at a resonant frequency.

BACKGROUND OF THE INVENTION

Radio communication systems are used by many in modern society to communicate. Many varied communication services, both voice communication services and data communication services, are regularly effectuated by way of radio communication systems. And, as technological advancements permit, the types of communication services effectuable by way of radio communication systems shall likely increase.

Cellular communication systems are exemplary of radio communication systems that have high levels of usage. Cellular communication systems are typically constructed to provide wide-area coverage. And, their infrastructures have been installed over significant portions of the populated areas of the world. A user communicates by way of a radio communication system through use of a wireless device, a radio transceiver, sometimes referred to as a mobile station or user equipment (UE). Typically, access to a cellular communication system is provided pursuant to purchase of a subscription, either on a revolving, i.e., monthly basis, or on a prepaid, time-usage basis. Cellular communication systems, operable pursuant to different operating standards, define radio air interfaces at different frequency bands, for instance, at the 800 MHz frequency band, at the 900 MHz frequency band, and at bands located between 1.7 GHz and 2.2 GHz.

Other types of radio communication systems are also widely used, for instance, Bluetooth (™)-based and IEEE 802.11b/g-based systems, implemented, e.g., as, WLAN (Wireless Local Area Network) systems, also provide for voice and data communications, generally over smaller coverage areas than their cellular counterparts. WLANs are regularly operated as private networks, providing users who have access to such networks the capability to communicate therethrough through the use of Bluetooth-capable or 802.11b/g-capable wireless devices. WLANs are sometimes configured to be connected to public networks, such as the Internet, and, in turn, to other communication networks, such as PSTNs (Public Switched Telephonic Networks) and PLMNs (Public Land Mobile Networks). Interworking entities also are sometimes provided to provide more-direct connection between the small-area networks and a PLMN. Various of the aforementioned systems are implemented at the 2.4 GHZ frequency band.

Radio communication systems are generally bandwidth-constrained. That is to say, bandwidth allocations for their operation are limited. And, such limited allocation of bandwidth, imposes limits upon the communication capacity of the communication system. Significant efforts have been made, and attention directed towards manners by which, to efficiently utilize the limited bandwidth allocated in bandwidth-constrained systems. Dual-polarization communication techniques are sometimes utilized. In a dual-polarization technique, data communicated at the same frequency is communicated in separate, polarized planes. Close to a doubling of the communication capacity is possible through the use of dual-polarization techniques. To transduce signal energy pursuant to a dual-polarization scheme, the wireless device is required to utilize a dual-polarized antenna, operable in the separate polarization planes. Use of dual-polarization techniques also are advantageous for the reason that the effects of multi-path transmission and other interference are generally reduced, thereby improving quality of signal transmission and reception.

A dual-polarized antenna is realizable, for instance, by feeding a square patch antenna at two orthogonal edges thereof by way of an edge feed or a probe feed. Generally, existing dual-polarized patch antennas are used in conjunction with two feeding-network circuits. Such existing antennas suffer from various limitations. For instance, separation distances between the feed connections are required to be great enough to prevent occurrence of coupling between the respective feeding lines. Excessive amounts of coupling results in high cross polarization levels.

As wireless devices are of increasingly small dimensions, packaged in housings of increasingly-smaller dimensions, problems associated with the cross-polarization levels are likely to become more significant. An improved, dual polarized antenna, constructed in a manner to reduce such deleterious problems is needed.

It is in light of this background information related to antennas for radio devices that the significant improvements of the present invention have evolved.

DETAILED DESCRIPTION

Figure 1:
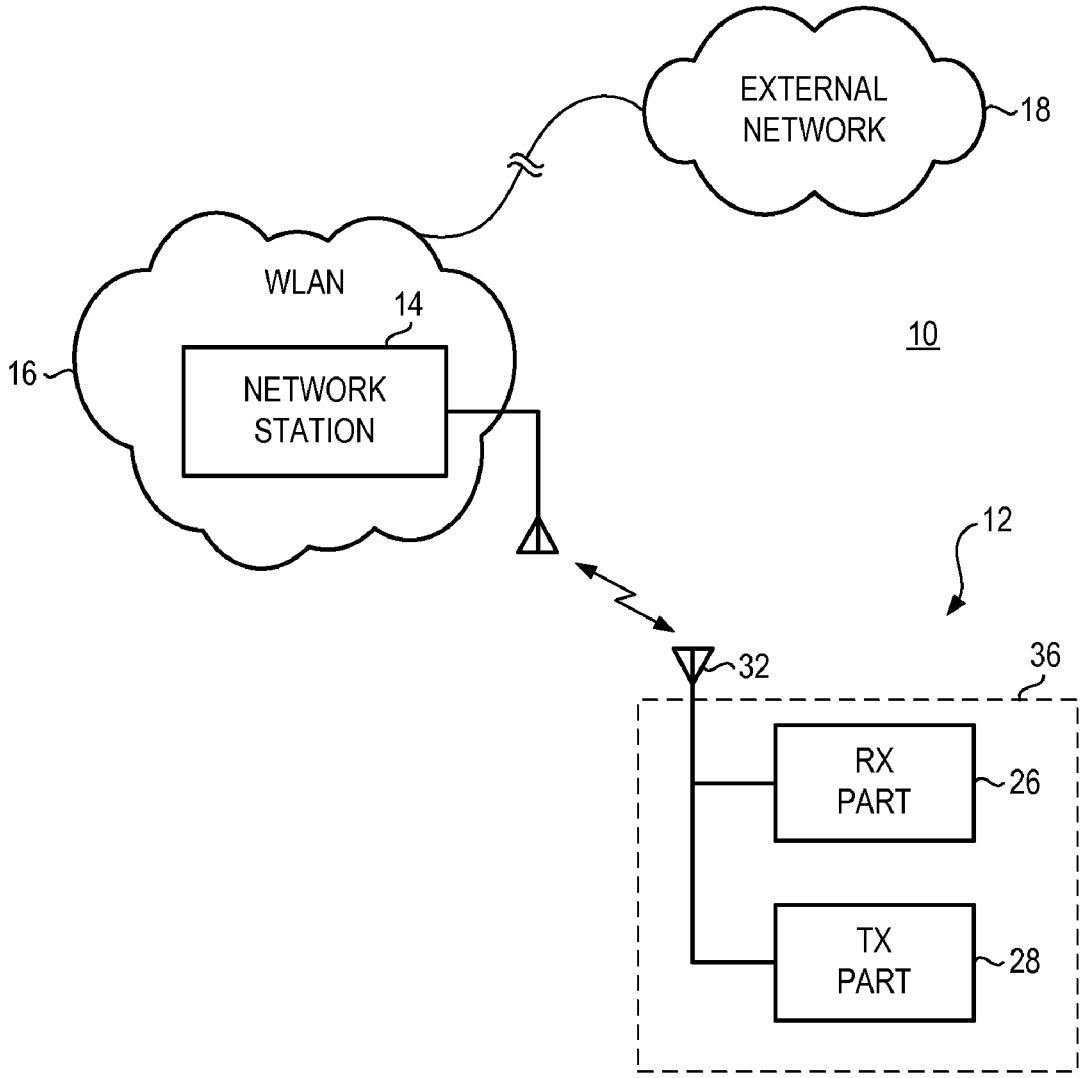
FIG. 1 illustrates a functional block diagram of a radio communication system in which an embodiment of the present invention is operable.

The present invention, accordingly, advantageously provides antenna apparatus, and an associated method, for a portable radio device, such as a Bluetooth-compatible or 802.11b/g-compatible device that operates at the IMS (Industry, Medical and Scientific) frequency band.

Through operation of an embodiment of the present invention, a dual-polarized antenna of compact construction is provided. The antenna is capable of positioning at, or within, a radio housing of the portable radio device.

In one aspect of the present invention, the antenna is formed of an array of corner-positioned patches that are disposed upon the substrate. The corner-positioned patches together with connector strips that interconnect adjacent patches are symmetrical in both a first polarization direction and a second polarization direction. And, the conductive material etched, or otherwise disposed, upon the substrate are symmetrically excitable at a resonant frequency, such as around 2.47 GHz, of the IMS frequency band.

In another aspect of the present invention, the corner-positioned patches form an array of patches in which each patch of the array is of a corresponding geometrical dimension. Each patch, for instance, is square-shaped. Each square-shaped patch is of a common lengthwise and widthwise dimension, thereby to permit the resultant array to be symmetrical in two directions, a first polarization direction and a second polarization direction in which the second polarization direction is orthogonal to the first polarization direction. The patches, for instance, are formed in the corners of a rectangular substrate such that the patches extend to the edge sides of the substrate.

In another aspect of the present invention, connector strips are disposed upon the substrate to interconnect adjacent ones of the patches of the array. As the patches are arranged in a two-by-two array, four connector strips, each connecting together a pair of adjacent strips are utilized. A connector strip extends in a first polarization direction or a second polarization direction depending on which pair of patches of the array that the connector strip interconnects. The connector strips are positioned to provide symmetry through an access that extends in the same polarization direction in which the connector strip extends. When positioned to connect adjacent patches of the two-by-two array, two of the four connector strips extend in the first polarization direction and are symmetrical about a polarization axis that extends in the first polarization direction. And, a second pair of the four connector strips extend in a second polarization direction and are symmetrical about a polarization axis that extends in a second polarization direction. The connector strips thereby interconnect each adjacent patch of the array and, in the aggregate, interconnect all of the patches of the array.

In another aspect of the present invention, a cross strip is disposed upon the substrate extending transversely between a pair of transverse-positioned patches of the array of patches. A single feed connection is provided at a midpoint of the transverse-extending cross strip. The feed connection provides for symmetrical excitation of the symmetrically-positioned parts of the antenna disposed upon the substrate. The symmetrical excitation is provided through the use of the single feed connection. Thereby, problems associated with cross polarization are reduced. And, a high-gain, high-efficiency, compact, dual-polarized antenna is thereby provided.

In these and other aspects, therefore, antenna apparatus, and an associated method, is provided for a radio device. A substrate is provided. And, a group of side-positioned patches are disposed in symmetrical arrangement upon the substrate. Connecting strips are disposed upon the substrate. The connecting strips are configured to connect together adjacent ones of the side-positioned patches of the group. A cross-strip is disposed upon the substrate. The cross strip is configured to connect together a pair of transversely-configured patches of the group of the side-positioned patches. The side-positioned patches provide for dual-polarization operation.

In these and other aspects, therefore, antenna apparatus, and an associated methodology is provided for a radio device. A substrate is provided. And a group of patches is disposed upon the substrate. The patches are configured to form a two-by-two array. A group of connecting strips is disposed upon the substrate. The connecting strips are configured to interconnect adjacent ones of the patches of the array. A transverse strip is further disposed upon the substrate, interconnecting a pair of transversely-positioned patches. These connecting strips not only act as feeding lines for the patches but also operate as in-phase radiation elements in each polarization direction.

Turning first, therefore, to FIG. 1, a radio communication system, shown generally at 10, provides for communications with a mobile station 12. The mobile station, in the exemplary implementation, operates pursuant to a Bluetooth standard or IEEE 802.11b/g standard, operable to send and to receive signals at the 2.4 GHz band. More generally, the mobile station 12 is representative of any of various wireless devices, and the radio communication system is representative of any various radio communication systems operable in conformity with any of various communication standards or permitting of operation at unregulated frequency bands. Accordingly, while the following description shall describe exemplary operation of a Bluetooth or IEEE 802.11b/g-compliant system, operable at the 2.4 GHz frequency band, it should be understood that the following description is merely exemplary and that the description of operation of the radio communication system operable in conformity in another manner is analogous.

The radio communication system includes a network part, here represented by a network station 14. The network station comprises, for instance, an access point of a WLAN or an analogous entity that transceives signals with wireless devices, such as the mobile station 12. The network station, which here forms an access point, is part of a local network structure (WLAN) 16 that, in turn, is coupled to an external network, here a public packet data network (PDN) 18, such as the Internet.

The operating standard pursuant to which the mobile and network stations are operable is permitting of, and here provides for, dual-polarized communications at the operational frequency band of the communication system, here an ISM band that extends between 2.40 and 2.485 GHz.

The mobile station 12 includes transceiver circuitry, here represented by a receive (RX) part 26 and a transmit (TX) part 28. The receive and transmit parts are coupled, such as by way of an antenna coupler or other entity that provides isolation between the transceiver parts to an antenna 32 of an embodiment of the present invention. The transceiver circuitry is capable of dual-polarization operation. That is to say, the transmit and receive parts are capable of generating signals for transmission in both of the polarization directions and also to operate upon signals communicated to the mobile station in both of the polarization directions.

Correspondingly, the antenna 32 forms a dual-polarized antenna, capable of transducing signal energy of both of the polarization directions. That is to say, signal energy is detected by the antenna in both of the dual-polarization directions. And, signal energy generated at the mobile station is transduced into electromagnetic form and radiated in both of the dual polarization directions. In the exemplary implementation, the antenna 32 is disposed upon a generally planar substrate, of dimensions permitting its positioning within a housing 36 of the mobile station.

Figure 2:
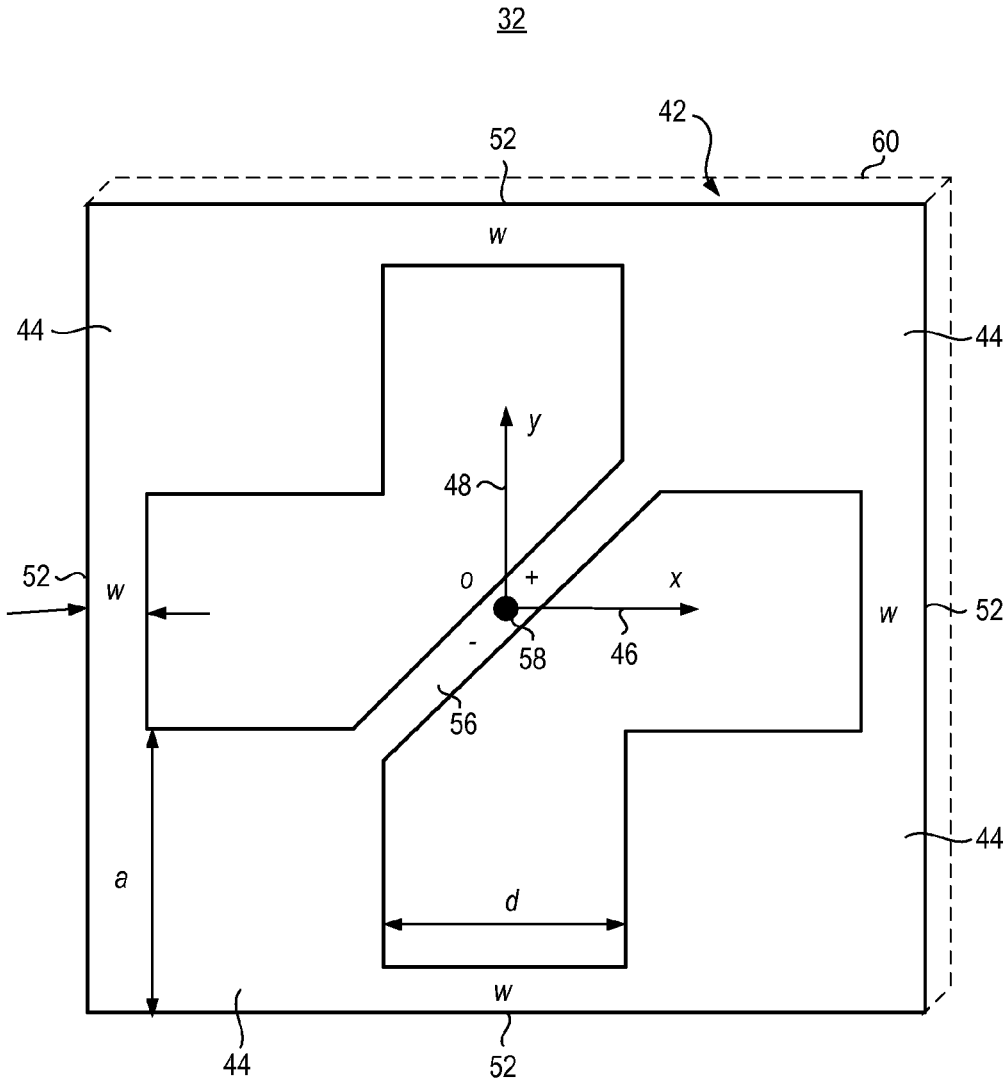
FIG. 2 illustrates a plan view of a dual-polarized, microstrip patch antenna of an embodiment of the present invention.

FIG. 2 illustrates in greater detail the antenna 32 of an embodiment of the present invention and that forms part of the mobile station 12, shown in FIG. 1. The antenna includes a plurality of patches 44 that are disposed upon a substrate 42. The patches are etched, painted, or otherwise formed upon the substrate. The patches are formed on the substrate in a manner that defines a two-by-two array of patches. That is, the patches are formed into two rows and two columns, each patch defined in a single row and a single column of the array.

In the exemplary implementation, the patches are of square geometry, i.e., are square-shaped. Each patch 44 is of a widthwise dimension of and is of a lengthwise dimension of a. In the exemplary implementation, the patches are each formed at the corners of substrate 42, here rectangular shaped. Thereby, edges of the substrate and of the outer peripheral sides of the patches are co-terminus. Through the use of the commonly-shaped and commonly-dimensioned patches, and through their positioning in the even array, the group of patches are symmetrical relative to two symmetry axes, here axes 46 and 48. The axes 46 and 48 are orthogonal to one another. And, the axes define mutually-orthogonal polarization directions.

Connecting strips 52 are also disposed upon the substrate 42. The connecting strips are also disposed, etched, or otherwise formed upon the substrate. Each connecting strip 52 is configured to interconnect an adjacent pair of the patches 44. In the two-by-two array, the patches are each connected to two connecting strips as the connecting strips connect patches of adjacent pairs of patches defined in each of the directions 46 and 48. The connecting strips, in the exemplary implementation, are rectangular-shaped, each of a width of w. And, the patches are separated by separation distances d. And, accordingly, each of the connecting strips is of a length of d. The connecting strips are also symmetrical about one of the symmetry axes 46 and 48. The resultant structure formed of the patches 44 and connecting strips 52 are, together, two-way symmetrical about the axes 46 and 48.

The antenna 32 further includes a cross strip 56 disposed, etched, or otherwise formed upon the substrate to extend transversely between a transverse-positioned pair of the patches 44. A feed connection 58 is defined midway along the length of the cross strip. The positioning of the feed connection provides for symmetrical excitation, thereby to reduce cross-polarization levels of dual-polarization components. In the exemplary implementation, the substrate further includes a common ground plane 60 formed upon a bottom (as-shown) side thereof. The common ground plane defines a reflector that is separated from the conductive elements that are disposed upon the substrate, and here separated by a distance defined by the thickness of the substrate.

Figure 3:
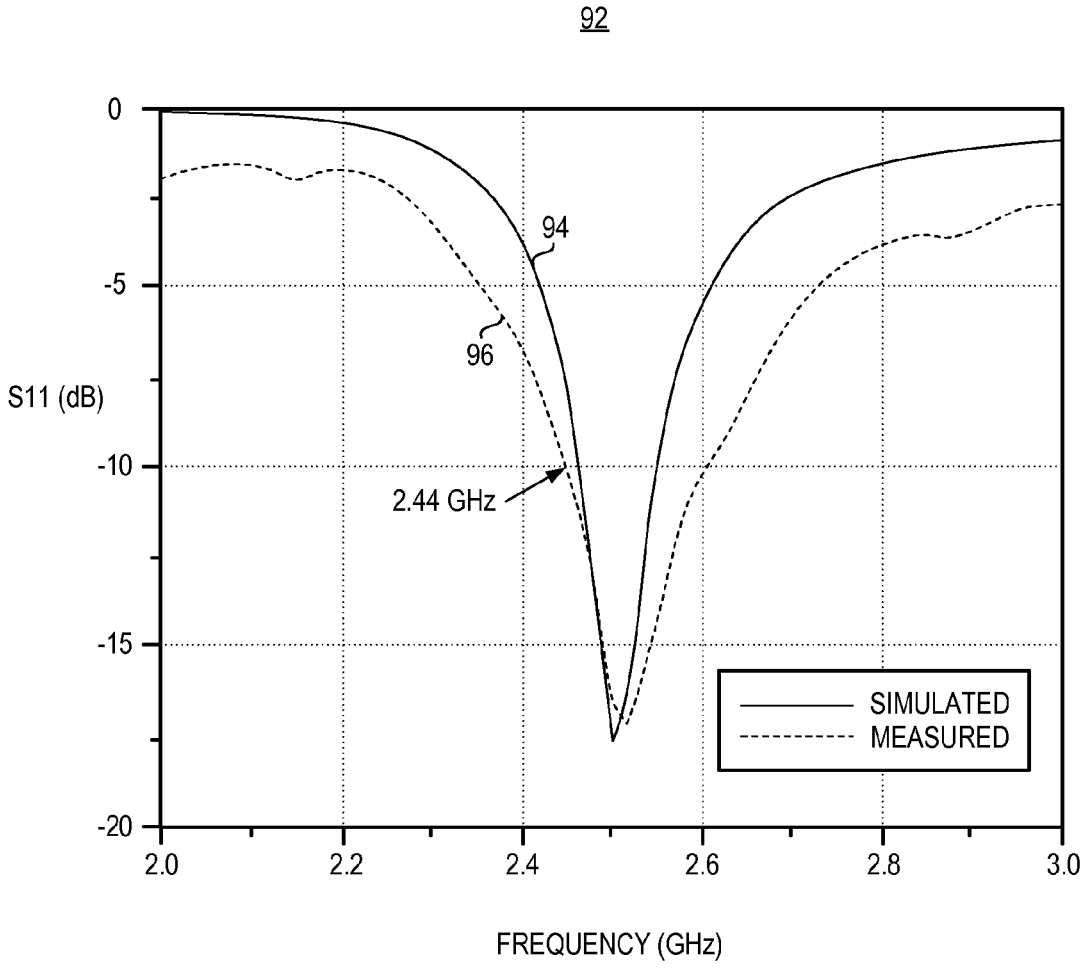
FIG. 3 illustrates a graphical representation showing simulated and measured return losses plotted as a function of frequency of an antenna forming part of a wireless device of an exemplary embodiment of the present invention.

FIG. 3 illustrates a graphical representation 92 illustrating plots 94 and 96 that are representative of simulated and measured return losses, respectively, plotted as a function of frequency. In the exemplary implementation, the antenna is resonant at the 2.4 GHz frequency band, and the plots are indicative thereof.

Figure 4:
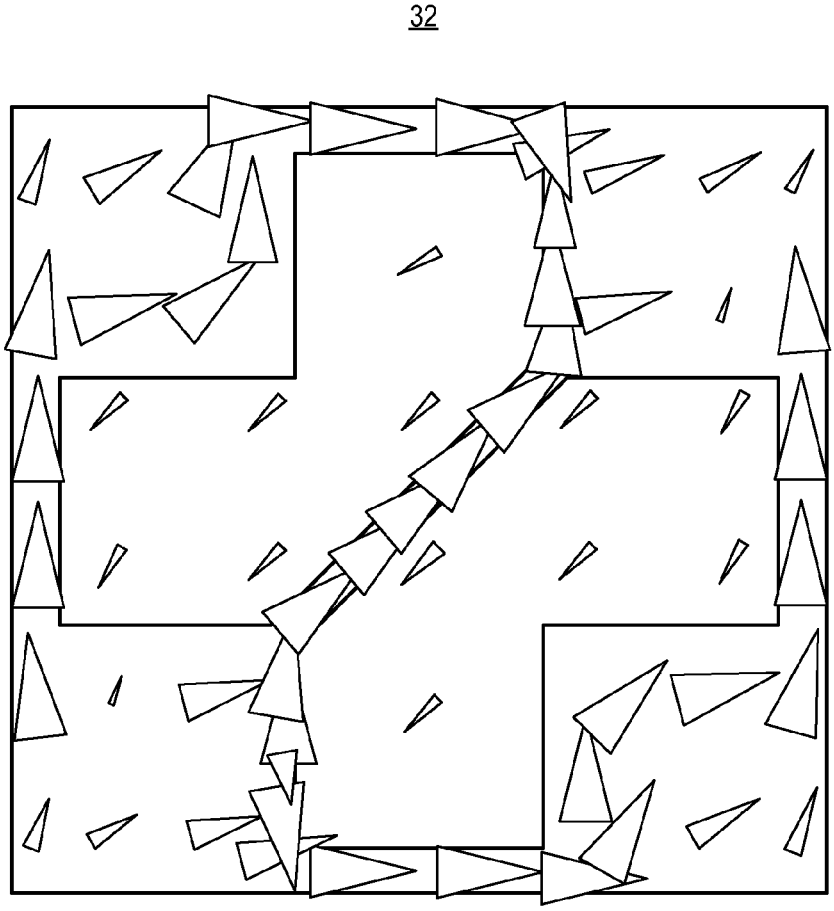
FIG. 4 illustrates a representation of an exemplary, simulated current distribution of an antenna of an embodiment of the present invention at 2.47 GHz.

FIG. 4 again illustrates the antenna 32 of an exemplary embodiment of the present invention. Here, a simulated current distribution exhibited by the antenna at its resonant frequency of 2.47 GHz. The antenna headers represent the current in the antenna. Analysis of the current distribution indicates that the current distribution includes components extending in directions parallel to the polarization axes 46 and 48 shown in FIG. 2.

Figure 5:
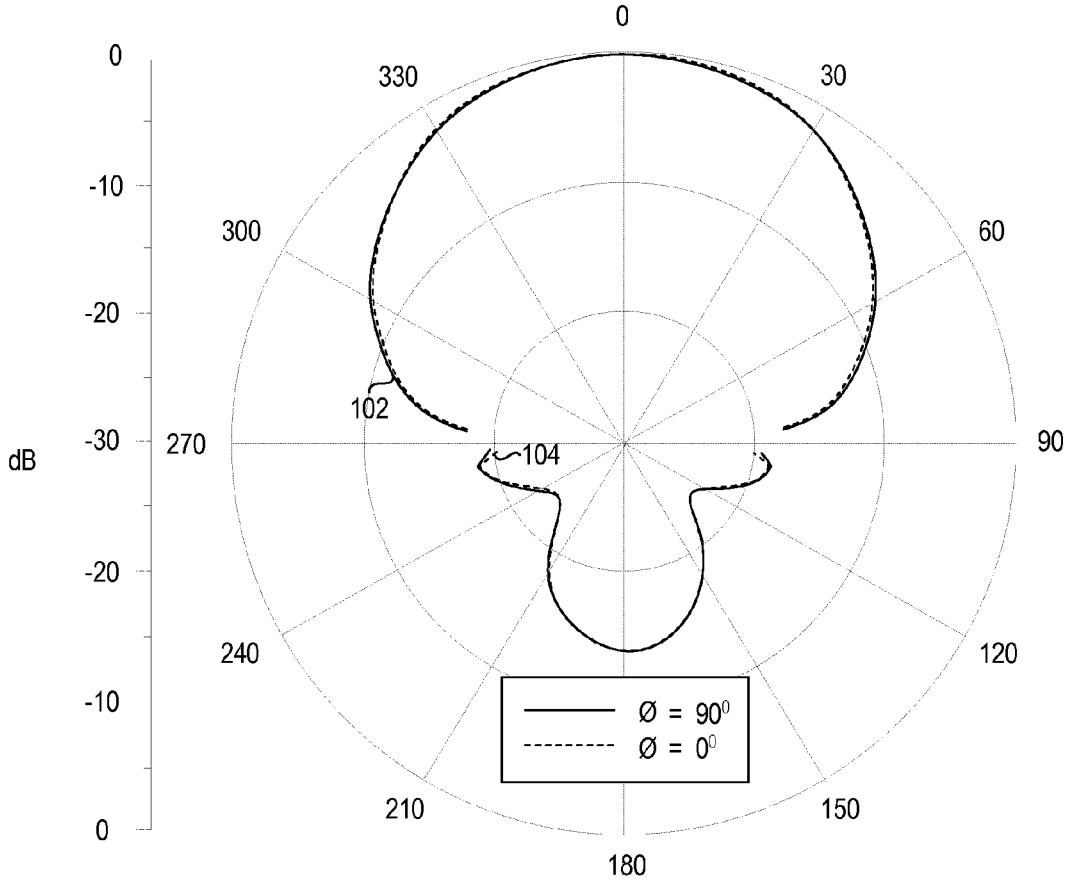
FIG. 5 illustrates a graphical representation of simulated radiation patterns of an antenna of an embodiment of the present invention at 2.47 GHz.
Figure 6:
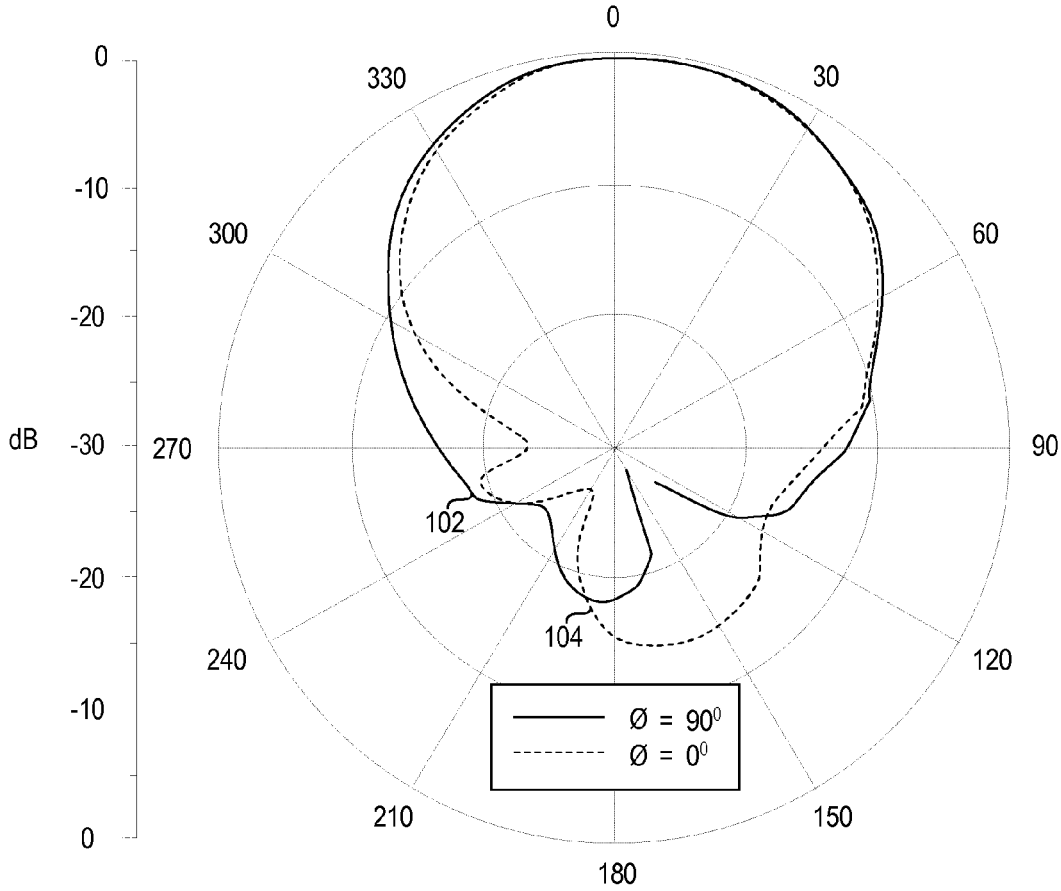
FIG. 6 illustrates a graphical representation, similar to that shown in FIG. 5, but of measured radiation patterns exhibited by an antenna of an embodiment of the present invention at 2.47 GHz.

FIGS. 5 and 6 illustrate, respectively, simulated and measured, two-dimensional, radiation patterns of the antenna 32 of an embodiment of the present invention at its 2.47 GHz resonant frequency. In each representation, both zero and ninety degree-plane representations 102 and 104 are plotted.

Figure 7:
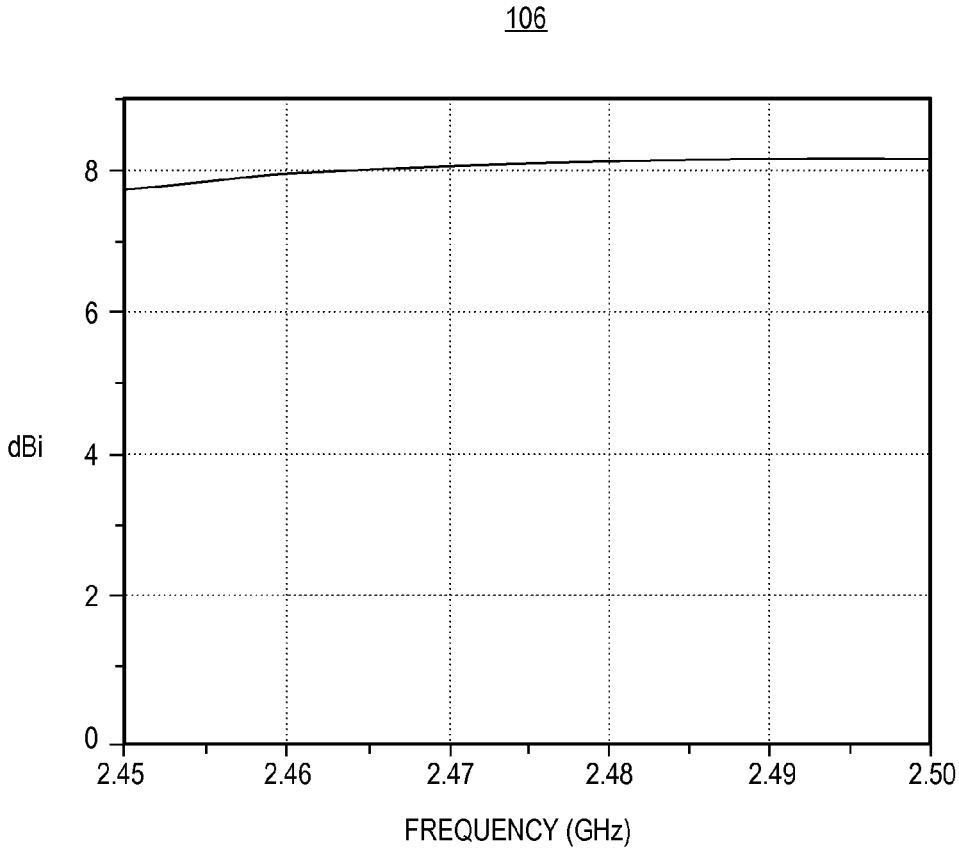
FIG. 7 illustrates a graphical representation showing simulated gain of an antenna of an embodiment of the present invention.

FIG. 7 illustrates a graphical representation 106 illustrating simulated gain, as a function of frequency, exhibited by the antenna 32 of an embodiment of the present invention. The gain is centered at, or close to, the 2.47 GHz resonant frequency.

Figure 8:
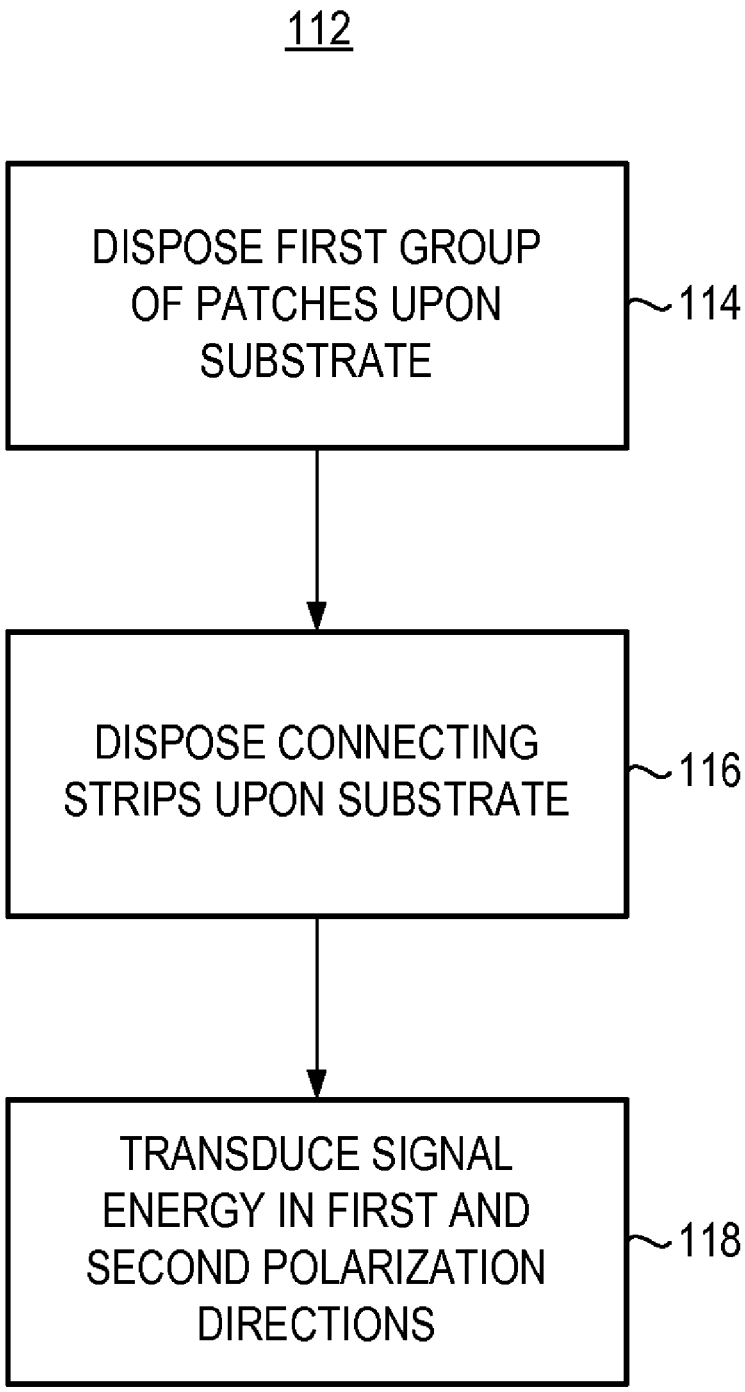
FIG. 8 illustrates a method flow diagram representative of the method of operation of an embodiment of the present invention.

FIG. 8 illustrates a method flow diagram, shown generally at 112, representative of the method of operation of an embodiment of the present invention. The method is for transducing signal energy at a radio device.

First, and as indicated by the block 114, a group of patches are disposed upon a substrate. The patches are configured to form a two-by-two array. And, as indicated by the block 116, a group of connecting strips are disposed upon the substrate. The strips of the connecting strips are configured to interconnect adjacent ones of the patches.

Once formed on the substrate, the patches are used to transduce signal energy, polarized in the polarization direction and in the second polarization direction, at the first and second groups, respectively, of the loop strips.

Thereby, a dual-polarized antenna, of compact dimensions is provided. Through the use of patches disposed upon a substrate, configured in a manner to permit use of a single feed connection to symmetrically excite the antenna, so-configured, obviates the problems associated with multiple feed connections used by conventional dual-polarized antennas are obviated.

What is claimed is:

1. Antenna apparatus for a radio device, said antenna apparatus comprising:

a substantially rectangular substrate;

a group of side positioned patches spaced apart from each other and disposed in a two-by-two symmetrical array upon said substrate;

connecting strips disposed upon said substrate, said connecting strips configured to connect together adjacent ones of the side-positioned patches of said group; and a single, diagonal cross strip disposed upon said substrate, said cross strip configured to extend transversely between a transverse-positioned pair of patches of said group of the side-positioned patches, the side-positioned patches providing for dual-polarization operation, said single cross strip having a feed connection, proximate to a midpoint of said cross strip.

2. The apparatus of claim 1 wherein the side-positioned patches disposed upon said substrate in said symmetrical arrangement are symmetrical in both a first polarization direction and in a second polarization direction.

3. The apparatus of claim 1 wherein said group of side-positioned patches comprises a first side-positioned patch, a second side-positioned patch, a third side-positioned patch, and a fourth side-positioned patch.

4. The apparatus of claim 3 wherein the patches are square and, wherein the first side-positioned patch is disposed at a first corner of said substrate, wherein the second side-positioned patch is disposed at a second corner of said substrate, wherein the third side-positioned patch is disposed at a third corner of said substrate, and wherein the fourth side-positioned patch is disposed at a fourth corner of said substrate.

5. The apparatus of claim 4 wherein a first connecting strip of said connecting strips connects together the first side-positioned patch with a second side positioned patch and, wherein a second connecting strip of said connecting strips connects together the second side-positioned patch with the third side-positioned patch, wherein a third connecting strip of said connecting strips connects together the third side-positioned patch with the fourth side-positioned patch, and wherein a fourth connecting strip of said connecting strips connects together the fourth side positioned patch with the first side-positioned patch.

6. The apparatus of claim 4 wherein said cross strip is configured to connect together the first side-positioned patch and the third side-positioned patch.

7. The apparatus of claim 1 wherein each side-positioned patch of said group of side-positioned patches is of a square geometry.

8. The apparatus of claim 7 wherein said cross strip is further configured to be of the first selected width.

9. The apparatus of claim 1 wherein each connecting strip of said connecting strips is configured to be of a first selected length and of a first selected width.

10. The apparatus of claim 1 wherein group of the side-positioned patches are configured to be resonant in both a first polarization direction and a second polarization direction at a 2.4 GHz frequency band.

11. A dual-polarized antenna apparatus for a radio device housed at a radio housing, said antenna apparatus comprising:

a substantially rectangular substrate positionable within the radio housing, said rectangular substrate having a rectangular top with four corners;

a plurality of square-shaped patches spaced apart from each other and arranged in a two-by-two array on said substrate, a square-shaped patch of said plurality disposed at each corner of said substrate, each square-shaped patch defined by edges extending in one of a first polarization direction and a second polarization direction;

a plurality of connecting strips disposed upon said substrate, a connecting strip of said plurality configured to connect adjacent ones of the square-shaped patches of said plurality of square-shaped patches, each connecting strip extending in one of the first polarization direction and the second polarization direction; and a single diagonal cross strip disposed upon said substrate, said cross-strip configured to extend transversely between and connect together a pair of transversely-positioned square-shaped patches of said plurality of the square-shaped patches, said cross-strip having a feed point proximate to the middle of said cross strip.

12. The dual-polarized antenna apparatus of claim 11 wherein said plurality of the square-shaped patches and said plurality of cross-strips are configured to be resonant at an ISM, Industrial Scientific and Medical, frequency band.

13. A method for transducing signal energy at a radio device, said method comprising the operations of:

disposing a group of side-positioned patches in a symmetrical two-by-two array upon a substantially rectangular substrate;

disposing connecting strips upon the substrate, the connecting strips configured to connect together adjacent ones of the side-positioned patches;

disposing a single, diagonal cross strip upon the substrate, the cross-strip configured to be extend transversely between and to connect together a pair of transversely-configured patches of the group of the side-positioned patches; and transducing signal energy, polarized in a first polarization direction and in a second polarization direction at the side-positioned patches of the group of side-positioned patches.

14. The method of claim 13 further comprising the operation of connecting a radio device to the cross-strip.

15. The method of claim 14 further comprising the operation of symmetrically exciting the side-positioned patches, the connecting strips, and the cross-strip disposed during said operations of disposing with signal energy.

16. The method of claim 15 wherein the signal energy provided during said operation of symmetrically exciting comprises signal energy of 2.4 GHz.

17. The method of claim 13 wherein said operation of disposing the group of the side-positioned patches comprises disposing the group in a two-by-two array of the side-positioned patches.

18. The method of claim 13 wherein the group of the side-positioned patches disposed during said operation of disposing the group of the side-positioned patches comprises the side-positioned patches in a first symmetrical arrangement in a first polarization direction and in a second symmetrical arrangement in a second polarization direction.

* * * * *